US007718909B2

(12) United States Patent
Masuda

(10) Patent No.: US 7,718,909 B2
(45) Date of Patent: May 18, 2010

(54) CONTACT HOLDING SHEET PROVIDED WITH A LIGHT GUIDE

(75) Inventor: Masazi Masuda, Shizuoka (JP)

(73) Assignee: Fuji Electronic Industries, Ltd., Shizuoka-Shi (JP)

( * ) Notice: Subject to any disclaimer, the term of this patent is extended or adjusted under 35 U.S.C. 154(b) by 0 days.

(21) Appl. No.: 12/218,707

(22) Filed: Jul. 17, 2008

(65) Prior Publication Data

US 2009/0283394 A1 Nov. 19, 2009

(30) Foreign Application Priority Data

May 19, 2008 (JP) ..... 2008-130325

(51) Int. Cl.
*H01H 9/00* (2006.01)

(52) U.S. Cl. ..... 200/310

(58) Field of Classification Search ..... 200/310
See application file for complete search history.

(56) References Cited

U.S. PATENT DOCUMENTS

| | | | | |
|---|---|---|---|---|
| 4,195,210 | A | 3/1980 | Pounds et al. | |
| 4,476,355 | A | 10/1984 | Mital | |
| 5,149,923 | A * | 9/1992 | Demeo | 200/5 A |
| 6,198,060 | B1 * | 3/2001 | Yamazaki et al. | 200/305 |
| 6,271,491 | B1 | 8/2001 | Ono et al. | |
| 6,960,733 | B2 * | 11/2005 | Hanahara et al. | 200/314 |
| 7,423,229 | B2 * | 9/2008 | Chen | 200/314 |
| 2007/0102272 | A1 * | 5/2007 | Sano et al. | 200/310 |

FOREIGN PATENT DOCUMENTS

| | | |
|---|---|---|
| JP | 9-198902 | 7/1997 |
| JP | 2001-028220 | 1/2001 |

* cited by examiner

*Primary Examiner*—Michael A Friedhofer
*Assistant Examiner*—Lheiren Mae A Caroc
(74) *Attorney, Agent, or Firm*—Flynn, Thiel, Boutell & Tanis, P.C.

(57) ABSTRACT

A contact holding sheet with a light guide without using a holding sheet with protrusions made of resin is provided. The contact holding sheet does not require a protrusion fabrication process, thereby reducing costs, and making the contact holding sheet thin without forming the protrusions on the holding sheet. The contact holding sheet includes a holding sheet opposed to a substrate, fixed contacts provided on the substrate, and dome-shaped movable contacts attached to a pressure sensitive adhesive surface of the holding sheet. The dome-shaped movable contacts face the substrate, and the movable contacts are opposed to the fixed contacts of the substrate. The protrusions are formed at central positions of the movable contacts and positioned inside holes formed in the holding sheet. The holding sheet and a light guide film are integrated with adhesion in a state where the light guide film is laid on upper portions of the protrusions.

9 Claims, 1 Drawing Sheet

CONTACT HOLDING SHEET PROVIDED WITH A LIGHT GUIDE

FIELD OF THE INVENTION

The invention relates to a contact holding sheet provided with a light guide for use in small switches to be built in a cellular phone and other portable electronic devices.

BACKGROUND OF THE INVENTION

There has been conventionally a contact holding sheet provided with a light guide, for example, as disclosed in JP 9-198902A and JP 2001-028220A. Small switches that are built in a cellular phone and other portable electronic devices are configured by dome-shaped movable contacts. Each of the movable contacts has a diameter of around 2 to 6 mm and fixed contacts that are opposed to the movable contacts. The movable contacts are held by the holding sheet. The fixed contacts are built in a substrate and opposed to the movable contacts.

In a state where the switches are built in the portable electronic devices, since the operation of switches is implemented by pushing central portions of the movable contacts, protrusions made of resin are formed on the holding sheet, and apexes of the protrusions are pushed to displace the movable contacts, thereby causing the movable contacts and the fixed contacts to be electrically brought into contact with each other. When the movable contacts come in contact with or separate from the fixed contacts, the switches are turned ON or OFF.

Meanwhile, the light guide made of a transparent film, and so forth is disposed between switch operation portions and the holding sheet for illuminating the switch operation portions. When the switches are operated, the light guide strikes against the protrusions made of resin, and cracks are liable to be generated in the light guide when implementing the life test of the switches, thereby causing a problem with durability.

SUMMARY OF THE INVENTION

It is an object of the invention to provide a contact holding sheet provided with a light guide without using a holding sheet provided with protrusions made of resin, and dispensing with a protrusion fabrication process, thereby reducing costs, and enabling the contact holding sheet provided with a light guide to be made thin without forming the protrusions on the holding sheet.

To that end, the contact holding sheet 1 provided with a light guide of the invention comprises a holding sheet 2 opposed to a substrate 3, fixed contacts 6 provided on the substrate 3, dome-shaped movable contacts 5 attached to a pressure sensitive adhesive surface of the holding sheet 2 facing the substrate 3 and opposed to fixed contacts 6 of the substrate 3, wherein protrusions 7 are formed at the central positions of the movable contacts 5, and positioned inside holes for protrusions formed on the holding sheet 2, and wherein the holding sheet 2 and a light guide film 9 are integrated with adhesion in a state where the light guide film 9 is laid on the upper portions of the protrusions 7.

Particularly, the protrusions 7 are formed of a material that is the same as that of the movable contacts 5 and trapezoidal or gently hemispherical, and the light guide film 9 is laid on the upper portions of the protrusions 7.

There are obtained the following effects according to the invention. Since the holding sheet provided with the protrusions made of resin is not used, and a protrusion fabrication process is dispensed with, it is possible to reduce the cost involved in fabricating the protrusions made of resin. Instead of forming the protrusions on the holding sheet per se, the protrusions 7 are disposed at the central positions of the movable contacts 5 in the holes 8 of the holding sheet 2, and the protruding dimensions of the protrusions 7 are absorbed in the holes 8 of the holding sheet 2, so that the protruding dimensions of the protrusions 7 do not become those of the protrusions 7 in the direction of thickness thereof as they are, thereby allowing the contact holding sheet to be made thin.

Since the protrusions 7 are formed of a material of the movable contacts 5 and they strike against the light guide film 9 at the upper flat surfaces, even if they are used for a long period of time, the protrusions are not deformed at the portions where the light guide film 9 strikes against the protrusions 7, and the generation of cracks is reduced, thereby contributing to a long operating life.

PREFERRED EMBODIMENT OF THE INVENTION

Figure 1:
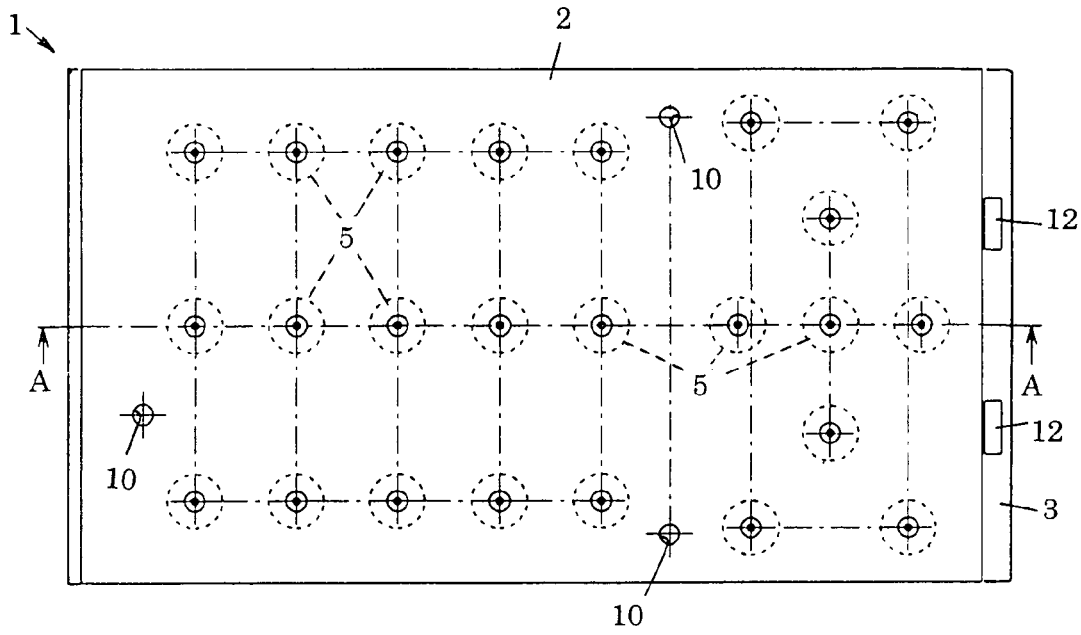
FIG. 1 is a plan view of a contact holding sheet provided with a light guide according to an embodiment of the invention.
Figure 2:
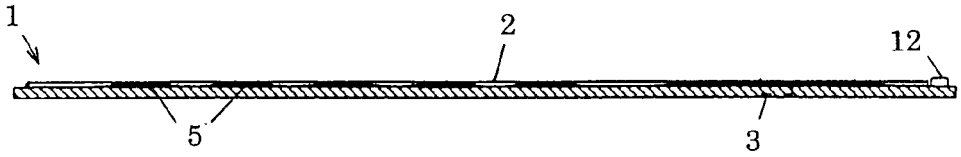
FIG. 2 is a sectional view of the contact holding sheet provided with a light guide taken along arrows A-A in FIG. 1.
Figure 3:
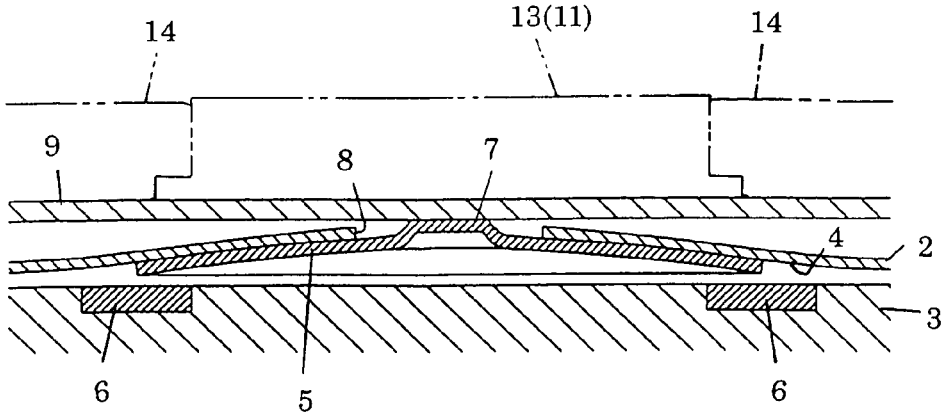
FIG. 3 is an enlarged sectional view of the contact holding sheet provided with a light guide in FIG. 1.

FIGS. 1 to 3 show an embodiment of a contact holding sheet 1 provided with a light guide that is built in key operation portions of a cellular phone, for example.

In these figures, the contact holding sheet 1 provided with the light guide comprises dome-shaped movable contacts 5 attached to a pressure sensitive adhesive surface of a holding sheet 2. The dome-shaped movable contacts 5 face a substrate 3 and are opposed to fixed contacts 6 of the substrate 3. Protrusions 7 are formed at central positions of the movable contacts 5 and are positioned inside holes 8 for the protrusions 7 formed on the holding sheet 2. The holding sheet 2 and a light guide film 9 are integrated with adhesion in a state where the light guide film 9 is laid on upper portions of the protrusions 7. Particularly, the protrusions 7 are made of the same material of the movable contacts 5 and formed in a trapezoidal shape at convex sides of the movable contacts 5. The light guide film 9 is laid on upper flat surfaces of the trapezoidal protrusions 7 with a surface contact.

The holding sheet 2 is made of, e.g. a PET pressure sensitive adhesive tape. The dome-shaped movable contacts 5 are attached in plural numbers on a pressure sensitive adhesive surface 4 made of an acylic pressure sensitive adhesive as a tape base material at positions corresponding to a ten key and various function keys. The respective movable contacts 5 are opposed to the fixed contacts 6. The fixed contacts 6 are formed on a surface of the substrate 3.

A multitude of movable contacts 5 are made of, e.g. stainless steel and formed dome-shaped (dish-shaped). The movable contacts 5 are press-molded products capable of implementing clicking action, and are attached to the pressure sensitive adhesive surface 4 of the holding sheet 2 at the convex portions in a state where concave portions of the movable contacts 5 are opposed to the fixed contacts 6 of the substrate 3. The trapezoidal protrusions 7 are formed integrally with the movable contacts 5 at the positions of the central apexes of the movable contacts 5 when they are press-molded. Each of the protrusions 7 is smaller than each hole 8 of the holding sheet 2. The diameter of each of the protrusions 7 is on the order of 0.3 to 1.0 mm and the height thereof is on the order of 0.05 to 0.3 mm. The diameter of each of the movable contacts 5 varies depending on the entire size of a cellular phone, but it is on the order of 2.0 to 6.0 mm.

The light guide film 9 is made of a translucent and transparent resin film, and it is integrated with the trapezoidal or gently inclined hemispherical protrusions 7 by partial adhesion, for example, by use of a pressure-sensitive adhesive double-coated tape, in a state where the light guide film 9 is laid on the upper portions of the protrusions 7 between the holding sheet 2 and the light guide film 9.

Three positioning holes 10 are formed on the holding sheet 2 for regulating the relative position between the holding sheet 2 and the substrate 3. When the holding sheet 2 is attached to the substrate 3 in a state where it is positioned relative to the substrate 3, one or at least two light sources 12 such as an LED, attached to the end portion of the substrate 3, are directed toward the end face of the light guide film 9.

The upper portion of each of the protrusions 7 is opposed to each key operation section 13 via the light guide film 9. The key operation section 13 is configured by each independent key top 11 supported by a case 14 for all the movable contacts 5 or by an integral flexible variable key pad, (not shown), that is common to all the movable contacts 5.

The contact holding sheet 1 provided with the light guide is built in, for example, the cellular phone at the position of each key operation surface thereof. When a user of the cellular phone puts each key operation section 13 in an operable mode, light from the light sources 12 enters the light guide film 9 from the end face of the light guide film 9, and implements total reflection on the interior of the light guide film 9. The light from the light sources is transmissive thereof, and is diffused at the portion of each key operation section 13 whereby the light illuminates each key operation section 13 from the back face thereof, thereby causing the key operation to be operable even at a dark place at night.

When the user presses the predetermined key operation section 13, the key operation section 13 presses each upper portion of each protrusion 7 of the dome-shaped movable contacts 5 via the light guide film 9 at the bottom face thereof, thereby causing each of the movable contacts 5 integrated with each protrusion 7 to be displaced in the direction of each of the fixed contacts 6. Since the light guide film 9 strikes against each of the protrusions 7 of the movable contacts 5 with a surface contact at this point in time, the light guide film 9 is scarcely broken or damaged, such as by cracking. Accordingly, the durability of the light guide film 9 is enhanced, and the contact holding sheet 1 provided with the light guide can function for a long period of time.

Each of the dome-shaped movable contacts 5 contacts each of the fixed contacts 6 of the substrate 3 while each movable contact 5 is displaced in the direction of the substrate 3, thereby causing the switch to be in an ON state. Before or after the ON state, each of the movable contacts 5 is reversed in the direction of the curve thereof, namely each of the movable contacts 5 implements a so-called click-action, so that the user can confirm an abrupt change of stroke caused by the click-action or an ON state of the switch based on the change, i.e. increase or decrease, of a force. Meanwhile, if the user decreases the force on each key operation section 13, each of the movable contacts 5 is returned elastically so that each of the fixed contacts 6 separates from each movable contact 5, thereby causing the switch to be in an OFF state.

Although the contact holding sheet 1 provided with the light guide of the invention is manufactured so as to be built in a cellular phone or small portable electronic devices, it can be used for other small key switches. If the contact holding sheet 1 provided with the light guide is used for other small key switches, it can be manufactured to have a configuration and size to be fitted in a structure of such small key switches. Further, as described above, each key operation section 13 can be configured with an integral key pad that is flexible and variable, and is common to all the movable contacts 5.

What is claimed is:

1. A contact holding sheet comprising:

a substrate mounting fixed contacts thereon;

a holding sheet disposed in opposed relation with said substrate, said holding sheet having a first side facing said substrate and including a pressure-sensitive adhesive surface and a second side facing away from said first side, said holding sheet defining therein a plurality of holes;

a plurality of dome-shaped movable contacts attached to said adhesive surface of said first side of said holding sheet in facing and opposed relation with said fixed contacts of said substrate, each said movable contact including a protrusion disposed at a central position on said movable contact and extending into a corresponding one of said holes of said holding sheet, the protrusion being the sole protrusion formed on the corresponding said movable contact; and a light guide film integrated with said holding sheet and positioned adjacent said second side of said holding sheet, said light guide film being disposed in adhering contact with respective upper portions of each of said protrusions.

2. The contact holding sheet of claim 1, wherein each said protrusion is formed of a material which is the same as a material from which the corresponding said movable contact is formed.

3. The contact holding sheet of claim 1, wherein each said protrusion is trapezoidal in shape.

4. The contact holding sheet of claim 1, wherein each said protrusion is hemispherical in shape.

5. The contact holding sheet of claim 1, wherein each said protrusion is formed of a material which is the same as a material from which the corresponding said movable contact is formed, and each said protrusion is one of; trapezoidal; and hemispherical in shape.

6. The contact holding sheet of claim 1, wherein each said movable contact defines an annular and upper circumferential surface attached to said adhesive surface of said first side of said holding sheet, each said protrusion being joined to said upper circumferential surface and projecting upwardly beyond said upper circumferential surface of the corresponding said movable contact.

7. The contact holding sheet of claim 1, wherein each said hole defined in said holding sheet defines a central axis and each said movable contact defines an annular circumferential surface facing away from said substrate and being attached to said adhesive surface of said first side of said holding sheet, each said protrusion projecting axially beyond said circumferential surface of the corresponding said movable contact towards said light guide film.

8. The contact holding sheet of claim 7, wherein said upper portion of each said protrusion has a flat surface disposed axially beyond said circumferential surface of the corresponding said movable contact towards said light guide film, said light guide film being disposed in adhering contact with each of said flat surfaces of the respective said protrusions.

9. The contact holding sheet of claim 1, wherein each said protrusion and the corresponding said movable contact are a monolithic, one-piece component formed of the same material.

* * * * *